United States Patent [19]

Kadija et al.

[11] 4,377,455

[45] Mar. 22, 1983

[54] V-SHAPED SANDWICH-TYPE CELL WITH RETICULATE ELECTODES

[75] Inventors: Igor V. Kadija; Kenneth E. Woodard, Jr., both of Cleveland, Tenn.

[73] Assignee: Olin Corporation, New Haven, Conn.

[21] Appl. No.: 285,724

[22] Filed: Jul. 22, 1981

[51] Int. Cl.[3] ..... C25B 1/34; C25B 9/00

[52] U.S. Cl. ..... 204/98; 204/128; 204/258; 204/266; 204/283

[58] Field of Search ..... 204/265, 266, 98, 128, 204/258, 283–284

[56] References Cited

U.S. PATENT DOCUMENTS

| | | | |
|---|---|---|---|
| 3,262,868 | 7/1966 | Juda | 204/265 |
| 3,379,634 | 4/1968 | Rutkowski | 204/253 |
| 3,926,769 | 12/1975 | Gritzner | 204/266 |
| 4,100,050 | 7/1978 | Cook et al. | 204/98 |

*Primary Examiner*—R. L. Andrews

*Attorney, Agent, or Firm*—James B. Haglind; Donald F. Clements

[57] ABSTRACT

An electrolytic cell for the electrolysis of aqueous solutions to produce gaseous products is comprised of a housing, a separator traversing said housing to form an anode compartment and a cathode compartment, an anode in the anode compartment, a cathode in the cathode compartment, means for introducing an electrolyte into and removing said electrolyte from said anode compartment, an outlet for gaseous products in the anode compartment, means for introducing a liquid into and removing a liquid from the cathode compartment, and an outlet for gaseous products in the cathode compartment. The electrolytic cell has at least one of the anode and the cathode comprising a porous electrode having a porosity in the range of from about 30 to about 98 percent, the porous electrode having a first portion in direct contact with the separator and a second portion spaced apart from the separator, the second portion being closer to said outlets for gaseous products than said first portion.

The electrolytic cell operates at reduced cell voltages with improved release of gas bubbles formed during electrolysis and improved liquid circulation through the porous electrode.

16 Claims, 3 Drawing Figures

V-SHAPED SANDWICH-TYPE CELL WITH RETICULATE ELECTODES

This invention relates to electrolytic cells for the electrolysis of alkali metal halides. More particularly, this invention relates to electrolytic cells having reduced cell voltages and improved fluid circulation.

Production of chlorine and alkali metal hydroxides in cells which electrolyze alkali metal chloride solutions has been a commercially important process for a number of years. One type of commercial electrolytic cell employs as a separator between the anodes and the cathodes a fluid permeable diaphragm. Maintenance of the desired fluid permeability of the diaphragm is an economically desirable aspect in the operation of the diaphragm cell. Thus dimensional stability is an important property for materials employed as diaphragms.

While asbestos has been the primary diaphragm material employed in diaphragm-type commercial chlorine cells, there has been an extensive search for materials having improved cell life and ionic selectivity. A large number of compositions have been proposed, particularly organic compounds such as vinyl chloride, acrylic acid, tetrafluoroethylene, ethylene, and styrene, among others which have been employed in polymers and copolymers. Recently ion exchange resins have been developed which have favorable ion exchange properties and which are inert to the alkali metal chloride electrolytes.

These ion exchange resins have been formed into separators which are hydraulically permeable diaphragms and separators which are hydraulically impermeable membranes. Hydraulically permeable diaphragms produced from these resins are more dimensionally stable in comparison with asbestos fiber diaphragms. Hydraulically impermeable membranes fabricated from these ion exchange resins are suitable for producing, for example, concentrated solutions of alkali metal hydroxides having very small amounts of alkali metal halides as contaminants.

Electrolytic cells employing as separators, porous diaphragms or impermeable membranes in the electrolysis of alkali metal halides have used foraminous metal electrodes constructed of perforated plates, meshes or screens, and expanded metals. These electrodes employ significant amounts of metal and have a high ratio of metal weight to surface area and have significant polarization values.

As the cost of electric power has increased, various ways have been sought to reduce the cell voltage or the electrode polarization values. One method of reducing the cell voltage is described in U.S. Pat. No. 4,209,368, issued June 24, 1980, to T. G. Coker et al where a foraminous electrode is bonded to a porous diaphragm composed of a cation exchange resin to eliminate the electrode-diaphragm gap. While the cell voltage in the electrolysis of alkali metal halide brines is reduced, attaching the electrode to the separator prohibits the re-use of the separator as the removal of the electrode results in damage to the separator.

Another method of reducing polarization values of foraminous metal electrodes is to employ expensive catalysts to reduce the electrode charge transfer activation barrier. Using these catalysts, any savings resulting from a reduction of power consumption has been offset by the increase in costs for the electrodes. In addition, these catalysts have a relatively short operational life.

An additional method of reducing cell voltage has been the development of three dimensional electrodes having increased surface area such as reticulate electrodes. A. Tentorio and U. Casolo-Ginelli have described one type of reticulate electrode (J. Applied Electro-Chemistry 8, 195–205, 1978) in which an expanded, reticulated polyurethane foam was metallized by means of the electroless plating of copper. A thin layer of copper (about 0.34$\mu$) was formed which conferred electrical conductivity to the matrix. Galvanic plating was employed to deposit additional amounts of copper. The reticulate electrode was employed in a cell for the electrolysis of a copper sulfate solution.

Now it has been discovered that further reductions of cell voltages can be accomplished in an electrolytic cell for the electrolysis of aqueous solutions to produce gaseous products which comprises a housing, a separator traversing the housing to form an anode compartment and a cathode compartment, an anode in the anode compartment, a cathode in the cathode compartment, means for introducing an electrolyte into and removing the electrolyte from the anode compartment, an outlet for gaseous products in the anode compartment, means for introducing a liquid into and removing a liquid from the cathode compartment, an outlet for gaseous products in the cathode compartment, at least one of the anodes and the cathodes comprising a porous electrode having a porosity in the range of from about 30 to about 98 percent, the porous electrode having a first portion in direct contact with the separator and a second portion spaced apart from the separator, the second portion being closer to the outlets for gaseous products than the first portion.

The novel electrolytic cell of the present invention is illustrated in FIGS. 1–3.

Figure 1:
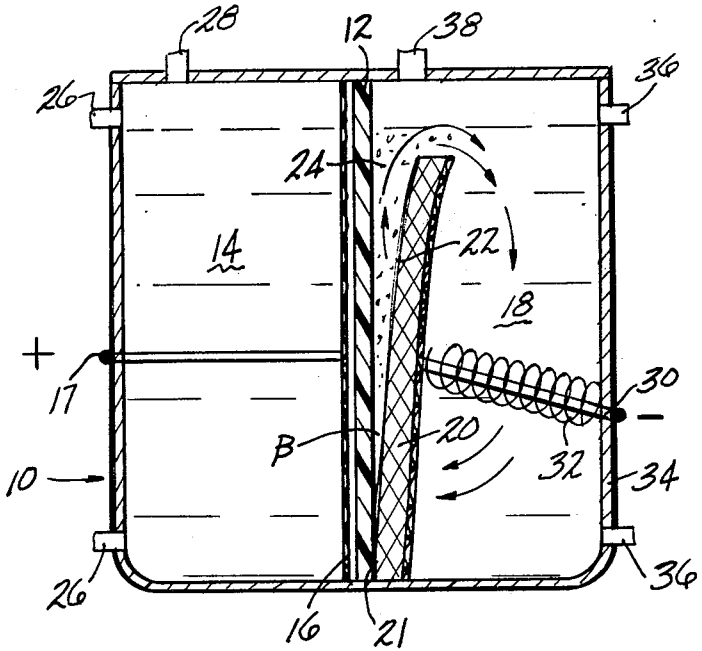
FIG. 1 illustrates a schematic view of one embodiment of the cell of the present invention in which a first portion of the cathode contacts the separator and a second portion is spaced apart from the separator.

In the schematic view illustrated in FIG. 1, electrolytic cell 10 is divided vertically by separator 12 into anode compartment 14 and cathode compartment 18. Anode compartment 14 contains anode 16 spaced apart from separator 12. Anode compartment 14 contains openings 26 for the introduction and removal of the electrolyte, and gas outlet 28. Electrical current is fed to anode 16 through conductor 17. Cathode compartment 18 contains porous cathode 20 having lower portion 21 compressed against separator 12 by compression means 32. Upper portion 22 of porous cathode 20 is spaced apart from separator 12 to form fluid release zone 24. Electrical current is carried from porous cathode 20 by conductor rod 30, which is fixed by welding or otherwise to the back of porous cathode 20, preferably substantially perpendicular thereto. Each conductor rod 30 is positioned at an angle to cell wall 34 to permit compression means 32, which surrounds conductor rod 30, to compress the lower portion 21 against separator 12 and maintain upper portion 22 spaced apart from separator 12. Compression means 32 compressingly contacts porous cathode 20 and cell wall 34. Cathode compartment 16 has openings 36 for the introduction and removal of liquids and gas outlet 38.

Figure 2:
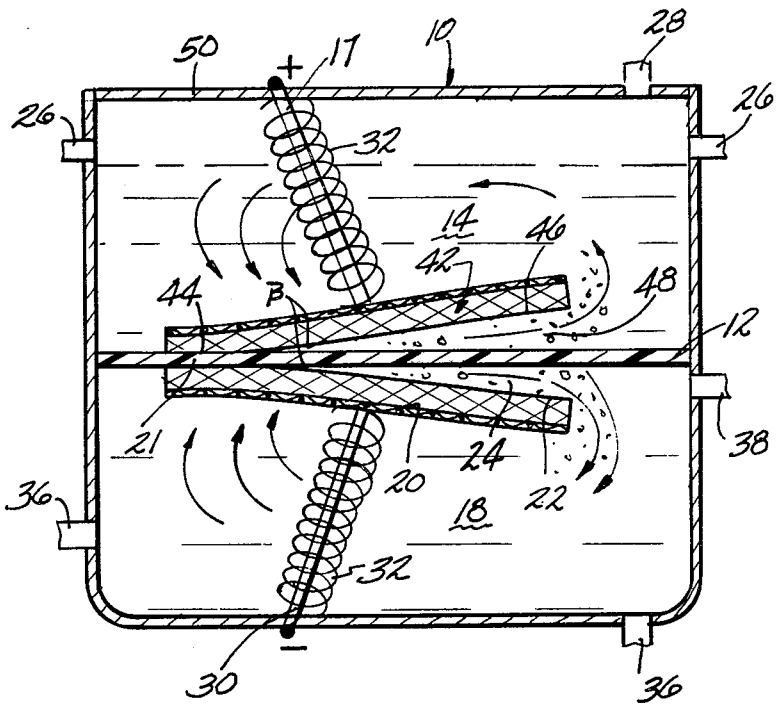
FIG. 2 shows a schematic view of another embodiment of the cell of the present invention in which a first portion of the anode and the cathode contact the separator and a second portion is spaced apart from the separator.

In the embodiment shown in FIG. 2, electrolytic cell 10 is horizontally divided by separator 12 into anode compartment 14 and cathode compartment 18. Porous anode 42 has first portion 44 compressed against separator 12 by compression means 32. Second portion 46 is spaced apart from separator 12 to form fluid release zone 48. Anode compartment 14 contains openings 26 for the introduction and removal of the electrolyte and gas outlet 28. Electrical current is fed to porous anode 42 through conductor 17. Compression means 32 surrounds conductor 17 and compressingly contacts porous anode 42 and cell wall 50. Cathode compartment 18 contains porous cathode 20 having first portion 21 compressed against separator 12 by compression means 32. Upper portion 22 of porous cathode 20 is spaced apart from separator 12 to form fluid release zone 24. Electrical current is carried from porous cathode 20 by conductor rod 30. Compression means 32 surrounds conductor rod 30 and compressingly contacts porous cathode 20 and cell wall 32. Openings 36 permit the introduction and removal of liquids from cathode compartment 18 while gas outlet 38 allows gaseous products to be removed.

Figure 3:
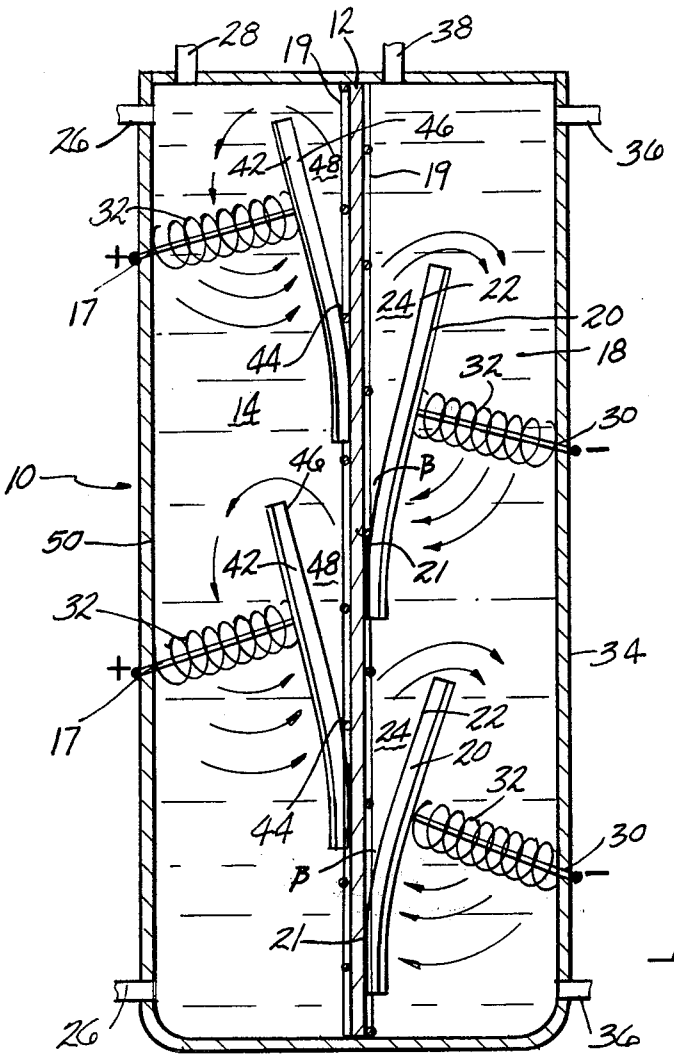
FIG. 3 depicts a schematic view of an additional embodiment of the cell of the present invention in which a plurality of the electrodes each have a portion in contact with the separator and a portion spaced apart from the separator.

FIG. 3 depicts an alternate embodiment of the electrolytic cell of the present invention in which a plurality of electrodes are positioned vertically. Separator 12 vertically divides electrolytic cell 10 into anode compartment 14 and cathode compartment 18. Support means 19 provide mechanical support along the sides of separator 12. Porous anodes 42, in anode compartment 14, have their lower portions 44 compressed against separator 12 and their upper portions 46 spaced apart from separator 12 to form fluid release zones 48. Similarly, porous cathodes 20, positioned in cathode compartment 18, have their lower portions 21 compressed against separator 12 and their upper portions 22 spaced apart from separator 12 to form fluid release zones 24. Porous anodes 42 and porous cathodes 20 are positioned along separator 12 so that the lower compressed portions of one electrode are opposite the upper portions of the opposing electrode.

Porous electrodes employed in the electrolytic cell of the present invention may be any suitable electrodes having a porosity in the range of from about 30 to about 98 percent. The porosity is defined as the ratio of the void to the total volume of the electrode.

In one embodiment, the porous electrodes are fabricated from a fine mesh or a perforated sheet or plate having a porosity above about 30 percent.

A preferred embodiment of the porous electrode is a three dimesional electrode such as a reticulate electrode. These electrodes have increased surface areas and particularly increased internal surface area. Their porosity is in the range of from about 70 to about 98, preferably, from about 80 to about 98, and more preferably from about 95 to about 98 percent.

A preferred embodiment of reticulate electrodes employed in the novel cell of the present invention is comprised of electroconductive filaments and a means of applying an electrical potential to the filaments. The term "filaments" as used in this specification includes fibers, threads, or fibrils. The filaments may be those of the electroconductive metals themselves, for example, nickel, titanium, platinum, or steel; or of materials which can be coated with an electroconductive metal.

Any materials which can be coated with these electroconductive metals may be used. Suitable materials include, for example, metals such as silver, titanium, or copper, plastics such as polyarylene sulfides, polyolefins produced from olefins having 2 to about 6 carbon atoms and their chloro- and fluoro- derivatives, nylon, melamine, acrylonitrile-butadiene-styrene (ABS), and mixtures thereof.

Where the filaments to be coated are non-conductive to electricity, it may be necessary to sensitize the filaments by applying a metal such as silver, nickel, aluminum, palladium, or their alloys by known procedures. The electroconductive metals are then deposited on the sensitized filaments.

In one method of fabricating reticulate electrodes, the filaments are affixed to a support fabric prior to the deposition of the electroconductive metal. Any fabric may be used as the support fabric which can be removed from the reticulate electrode structure either mechanically or chemically. Support fabrics include those which are woven or non-woven and can be made of natural fibers such as cotton or rayon or synthetic fibers including polyesters, nylons, polyolefins such as polyethylene, polypropylene, polybutylene, polytetrafluoroethylene, or fluorinated ethylenepropylene (FEP) and polyarylene compounds such as polyphenylene sulfide. Preferred as support fabrics are those of synthetic fibers such as polyesters or nylon. Fabric weights of 100 grams per square meter or higher are quite suitable for the support fabrics.

Filaments are affixed to the support fabric in arrangements which provide a web or network having the desired porosity. The filaments are preferably randomly distributed while having a plurality of contact points with adjacent filaments. This can be accomplished by affixing individual filaments in the desired arrangement or by providing a substrate which includes the filaments. Suitable substrates are light-weight fabrics having a fabric weight, for example, in the range of from about 4 to about 75 grams per square meter. A preferred embodiment of the substrate is a web fabric of, for example, a polyester or nylon.

Filaments may be affixed to the support fabric or the substrate, for example, by sewing or needling. Where the filaments are affixed to a thermoplastic material, energy sources such as heat or ultrasonic waves may be employed. It may also be possible to affix the filaments by the use of an adhesive.

Where the filaments themselves are not an electroconductive metal, an electroconductive metal is deposited on the filaments, for example, by electroplating.

In an alternate embodiment, the reticulate electrode is formed of metal filaments woven into a web or net which is then attached to a metal support such as a screen or mesh. The metal web may be attached to the support, for example, by sintering or welding. An electroconductive metal may then be deposited onto the filaments.

In another embodiment, the reticulate electrode is fabricated from expanded foam structures such as those of polyurethane or acrylonitrile-butadiene-styrene (ABS) which have been coated with an electroconductive metal.

Any electroconductive metal may be used which is stable to the cell environment in which the electrode will be used and which does not interact with other cell components. Examples of suitable electroconductive metals include nickel, nickel alloys, molybdenum, molybdenum alloys, vanadium, vanadium alloys, iron, iron alloys, cobalt, cobalt alloys, magnesium, magnesium alloys, tungsten, tungsten alloys, gold, gold alloys, platinum group metals, and platinum group metal alloys. The term "platinum group metal" as used in the specification means an element of the group consisting of platinum, ruthenium, rhodium, palladium, osmium, and iridium.

Where the electrode will contact an aqueous solution of an alkali metal hydroxide, it is preferred that the electroconductive metal coating be that of nickel or nickel alloys, molybdenum and molybdenum alloys, cobalt and cobalt alloys, lanthanum and lanthanum alloys, and platinum group metals and their alloys. Where the electrode will contact an aqueous solution of an alkali metal chloride, the electroconductive metal coating may be that of a platinum group metal or an alloy of a platinum group metal.

For metal filaments coated with an electroconductive metal, the amount deposited should be sufficient to provide suitable electrochemical activity and the desired electrical properties.

Sufficient amounts of the electroconductive metal are deposited on non-metallic filaments to produce an electrode structure having adequate mechanical strength and which is sufficiently ductile to withstand the stresses and strains exerted upon it during its use in electrolytic processes without cracking or breaking. Suitable amounts of electroconductive metals include those which increase the diameter of the filaments up to about 5 times and preferably from about 2 to about 4 times the original diameter of the filaments. While greater amounts of electroconductive metal may be deposited on the filaments, the coated filaments then tend to become brittle and to powderize.

After deposition of the electroconductive metal has been accomplished, any support fabric present is removed. With cloth-like fabrics, these can be readily peeled off or cut off the metal structure. Non-woven or felt support fabrics can be, for example, loosened or dissolved in solvents including bases such as alkali metal hydroxide solutions or acids such as hydrochloric acid. Any solvent may be used to remove the support fabrics and substrates which will not corrode or detrimentally effect the electrode structure. Heating may also be employed, if desired, to remove the support fabrics. Where a substrate containing the filaments in used, the temperature to which the metal coated electrode is heated should be less than the melting point or decomposition temperature of the substrate.

Separators employed in the novel electrolytic cell of the present invention include hydraulically permeable (porous) diaphragms and hydraulically impermeable membranes.

Hydraulically permeable diaphragms include diaphragms of chrysotile, crocidolite, and anthophyllite asbestos fibers, and mixtures thereof. Also included are porous asbestos diaphragms which have been modified by the incorporation of polymeric materials such as polymers or fluorinated hydrocarbons. Examples of suitable fluorinated hydrocarbon include polytetrafluoroethylene, fluorinated ethylene-propylene (FEP), polychlorotrifluoroethylene, polyvinyl fluoride, polyvinylidene fluoride and copolymers of ethylene-chrlorotrifluoroethylene.

Other porous diaphragms which may be employed include those comprising a support fabric impregnated with an active component containing silica which is permeable to, for example, alkali metal chloride brines. The support fabric is produced from thermoplastic materials which are chemically resistant to and dimensionally stable in the gases and electrolytes present in the electrolytic cell. The fabric supports are substantially nonswelling, nonconducting and nondissolving during operation of the electrolytic cell. Suitable porous diaphragms of this type include those, for example, described in U.S. Pat. No. 4,207,164, issued June 10, 1980, to I. V. Kadija and U.S. Pat. No. 4,216,072, issued Aug. 5, 1980, to I. V. Kadija.

Preferred as separators in the electrolytic cell of the present invention are hydraulically impermeable membranes comprised of ion exchange resins such as those composed of fluorocarbon resins having cation exchange properties. Suitably used are cation exchange membranes such as those composed of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are meant to include salts of sulfonic acid or salts of carboxylic acid, for example, alkali metal salts which are suitably converted to or from the acid groups by processes such as hydrolysis. One example of a suitable membrane material having cation exchange properties is a perfluorosulfonic acid resin membrane composed of a copolymer of a polyfluoroolefin with a sulfonated perfluorovinyl ether. The equivalent weight of the perfluorosulfonic acid resin is from about 900 to about 1600 and preferably from about 1100 to about 1500. The perfluorosulfonic acid resin may be supported by a polyfluoroolefin fabric. A composite membrane sold commercially by E. I. duPont de Nemours and Company under the trademark "Nafion" is a suitable example of this membrane.

A second example of a suitable membrane is a cation exchange membrane using a carboxylic acid group as the ion exchange group. These membranes have, for example, an ion exchange capacity of 0.5–4.0 mEq/g of dry resin. Such a membrane can be produced by copolymerizing a fluorinated olefin with a fluorovinyl carboxylic aacid compound as described, for example, in U.S. Pat. No. 4,138,373, issued Feb. 6, 1979, to H. Ukihashi et al. A second method of producing the above-described cation exchange membrane having a carboxyl group as its ion exchange group is that described in Japanese Patent Publication No. 1976-126398 by Asahi Glass Kabushiki Gaisha issued Nov. 4, 1976. This method includes direct copolymerization of fluorinated olefin monomers and monomers containing a carboxyl group or other polymerizable group which can be converted to carboxyl groups. Carboxylic acid type cation exchange membranes are available commercially from the Asahi Glass Company under the trademark "Flemion."

In the electrolytic cell of the present invention, at least one porous electrode is in direct contact with the separator along a first portion of the length of the electrode. This first portion is from about 5 to about 50 percent, and preferably from about 15 to about 35 percent of the length of the electrode. The first portion is brought into contact with the separator by compression means which press the first portion of the electrode against the separator substantially eliminating the gap between the porous electrode and the separator. Any suitable compressions means may be employed including mechanical means such as springs, including helical, conical, volute, or leaf springs; hydraulic means such as rams or cylinders; wedges and similar devices used in combination with clamping means and placed, for example, along the frame of the electrodes; etc. The second portion of the porous electrode is spaced apart from the separator. As shown in FIGS. 1–3, the spacing increases along the length of the second portion to a maximum at the end of the electrode at which gas bubbles are released. It is desired that the maximum gap between electrodes be no greater than about 13 millimeters, and preferably from about 3 to about 7 millimeters. This limits the angle of inclination, $\beta$, between the separator and the second portion of the electrode to the range of from about 1 to about 10, and preferably from about 2 to about 8 degrees. Where both electrodes are porous and the second portions are spaced apart from the separator, the combined angles between the inclined portions of the porous electrodes and the separator should be no greater than about 10 degrees.

In one embodiment of the electrolytic cell of the present invention, where both the anode and cathode are porous electrodes, electrical resistance is minimized by positioning the electrodes in a staggered arrangement, as shown in FIG. 3. Thus one electrode has the first portion in contact with the separator opposite the second portion of the second electrode which is spaced apart from the separator. When employing this staggered arrangement with more than one electrode of the same polarity, overlapping of the first portion of the electrode with the second portion of an adjacent electrode is avoided.

Where both the anodes and cathodes are porous electrodes having a portion of the electrode in direct contact with the separator, it may be desirable to provide additional mechanical support. This can be accomplished by the use of support means as shown, for example, in FIG. 3 by placing against or attaching to the separator a supporting structure such as a mesh or screen. The support means should have large open areas, i.e. at least about 3 centimeters square, to prevent interference with the electrolytic processes and gas release.

While, as illustrated in FIGS. 1 and 2, the separator may be positioned horizontally or vertically within the cell, the separator may be positioned at any angle, for example, from about 0° to about 90° C., where 0° represents the vertical position as shown in FIG. 1, and 90° the horizontal position depicted in FIG. 2. In a preferred embodiment, the separator is positioned substantially vertically.

The novel electrolytic cell of the present invention may be used in the electrolysis of any electrolytes which produce gaseous products. For example, the cells may be employed in the electrolysis of alkali metal halides such as sodium chloride, potassium chloride, sodium bromide, and potassium bromide to produce chlorine or bromine, hydrogen and an alkali metal hydroxide. Hydrogen and oxygen gases may be produced by the electrolysis of water containing, for example, as an electrolyte, an alkali metal hydroxide. Preferably, the novel electrolytic cells are employed in the production of chlorine, hydrogen, and an alkali metal hydroxide by the electrolysis of an alkali metal chloride.

During electrolysis, a difference in density exists between the gas containing electrolyte in the fluid release zone between the separator and the second portion of the porous electrode, and the electrolyte in other areas of the electrode compartment, for example, such as the area behind the porous electrode. As the cell current increases, the difference in electrolyte density increases, and, in turn, the circulation of the electrolyte through the porous electrode increases. At high current densities, sufficient gas bubbles are generated in the fluid release zone, for example, to reduce the density of the electrolyte within the zone to about 50 percent of that of the surrounding electrolyte. Rapid release of these gas bubbles from the fluid release zone results in high circulation rates of the electrolyte through the porous electrode structure and thus enables the cell to operate at low voltages while employing high current densities. Improved electrolyte circulation through the first section of the porous electrode is induced in the direction shown in FIGS. 1–3.

Thus the novel electrolytic cell of the present invention operates at reduced cell voltages with improved release of gas bubbles formed during electrolysis and improved liquid circulation through the porous electrode. As a further result of the improved gas release and liquid circulation, the formation of foam within the electrode compartments is reduced.

The following examples are presented to illustrate the invention more fully without being limited thereby.

EXAMPLE 1

A reticulate anode was fabricated by spot welding a titanium felt (ca 150 grams per square meter) onto a titanium mesh support. The anode had a porosity of about 98 percent. A reticulate cathode was produced by needling a web of silver coated nylon fibers (20 grams per square meter; fiber diameter about 10 microns) onto a section of a polyester cloth (250 grams per square meter; air permeability 50 cubic meters per minute per square meter). A current distributor was attached to the web and the web-polyester cloth composite was immersed in an electroplating bath containing 450 grams per liter of nickel sulfamate and 30 grams per liter of boric acid at a pH in the range of 3–5. Initially electric current was passed through the solution at a current density of about 0.2 $KA/m^2$ of electrode surface. After about 10 minutes, the current was increased to provide a current density of 0.5 $KA/m^2$. During the electroplating period of about 3 hours, an electroconductive nickel coating was deposited on the silver fibers. Where adjacent fibers touched, plated joints formed to bond the fibers together into a network. After removal from the plating bath, the nickel plated structure was rinsed in water. The current distributor and the polyester fabric were peeled off and an integrated nickel plated structure obtained having a porosity of 96 percent and weight of 580–620 grams per square meter in which the nickel coated fibers had a diameter, on the average, about 30 microns. The reticulate anode and reticulate cathode were installed in an electrolytic cell having a cation exchange membrane (E. I. duPont de Nemours & Company "Nafion" perfluorosulfonic acid resin cation exchange membrane) vertically separating the anode compartment from the cathode compartment. The lower portion of the electrodes were compressed against the membrane by springs which encompassed the conductor rods supplying current to the electrodes. The springs contacted in the back of the electrodes and a wall of the cell and provided a pressure of about 0.1 $Kg/cm^2$ at the contact area. The upper portions of the electrodes were spaced apart from the membrane by a spacer contacting the membrane and the top of the electrode, the angle B between the membrane and the separator being about 5°. Angle B was maintained by angularly positioning the conductor rod, as illustrated in FIGS. 1-3. An aqueous solution of sodium chloride (300 grams per liter) at a temperature in the range of 82°-85° C., was employed as the electrolyte. The cell was operated at a current density of 2 KA/m$^2$ to produce chlorine gas in the anode compartment and hydrogen and 33% sodium hydroxide in the cathode compartment. During electrolysis, gas bubbles were rapidly released from the area between the upper portions of the electrodes and the membrane and circulatory motion of the electrolyte through the porous electrode was visible. The cell voltage was 3.05 volts.

EXAMPLE 2

Using the identical cell of EXAMPLE 1, the procedure of EXAMPLE 1 was repeated with the single exception that the cell was operated at a current density of 4 KA/m$^2$. During cell operation, rapid gas release and vigorous circulatory motion of the electrolyte was visually observed. Cell voltage was found to be 3.5 volts.

COMPARATIVE EXAMPLE A

The electrolytic cell of EXAMPLE 1 was operated with the reticulate anode and the reticulate cathode compressed against the membrane over the entire length of the electrodes eliminating the electrode-membrane gap. Electrolysis of the sodium chloride electrolyte of EXAMPLE 1 at a current density of 2 KA/m$^2$ resulted in a cell voltage of 3.2 volts.

COMPARATIVE EXAMPLE B

The procedure of COMPARATIVE EXAMPLE A was repeated where the only change was the operation of the cell at a current density of 4 KA/m$^2$. The cell voltage was found to be 3.6 volts.

COMPARATIVE EXAMPLE C

An electrolytic cell of the type and size of EXAMPLE 1 was equipped with an expanded titanium metal mesh anode (porosity 37%) having a ruthenium oxide coating and an expanded nickel mesh (porosity 40%) cathode separated by the same membrane as used in EXAMPLES 1 and 2 and COMPARATIVE EXAMPLES A and B. The anode and the cathode were each spaced about 3 millimeters apart from the membrane. Electrolysis of the sodium chloride electrolyte of EXAMPLE 1 at a current density of 2 KA/m$^2$ resulted in a cell voltage of 3.5 volts.

COMPARATIVE EXAMPLE D

The electrolysis method of COMPARATIVE EXAMPLE C was repeated at a current density of 4 KA/m$^2$, the only change in cell operation. The cell voltage was found to be 4.6 volts.

Results of EXAMPLES 1-2 and COMPARATIVE EXAMPLES A, B, C, and D are summarized below.

TABLE I

| Example | Current Density (KA/m$^2$) | Cell Voltage (volts) |
|---|---|---|
| 1 | 2 | 3.05 |
| Comparative A | 2 | 3.2 |
| Comparative C | 2 | 3.5 |

TABLE I-continued

| Example | Current Density (KA/m$^2$) | Cell Voltage (volts) |
|---|---|---|
| 2 | 4 | 3.5 |
| Comparative B | 4 | 3.6 |
| Comparative D | 4 | 4.6 |

As shown in TABLE I, there is a significant reduction in cell voltage in operating the cell of the present invention, as exemplified by EXAMPLES 1 and 2 over the cells of COMPARATIVE EXAMPLES A, B, C, and D. This is particularly surprising in view of teachings that the maximum cell voltage reduction is obtained where there is substantially no gap between the electrode and the membrane, as shown in COMPARATIVE EXAMPLES A and B.

What is claimed is:

1. An electrolytic cell for the electrolysis of aqueous solutions to produce gaseous products which comprises a housing, a separator traversing said housing to form an anode compartment and a cathode compartment, an anode in said anode compartment adjacent to said separator, a cathode in said cathode compartment adjacent to said separator, means for introducing an electrolyte into and removing said electrolyte from said anode compartment, an outlet for gaseous products in said anode compartment, means for introducing a liquid into and removing a liquid from said cathode compartment, an outlet for gaseous products in said cathode compartment, means for supplying electrical current to said anode and said cathode, at least one of said anode and said cathode comprising a porous electrode having a porosity in the range of from about 30 to about 98 percent, said porous electrode having a first portion in direct contact with said separator and a second portion spaced apart by an angle of inclination from said separator, said second portion being closer to said outlets for gaseous products than said first portion.

2. The electrolytic cell of claim 1 in which said separator is selected from the group consisting of hydraulically permeable diaphragms and hydraulically impermeable ion exchange members.

3. The electrolytic cell of claim 2 in which compression means are employed to maintain said first portion in contact with said separator.

4. The electrolytic cell of claim 3 in which said first portion is from about 5 to about 50 percent of the length of said porous electrode.

5. The electrolytic cell of claim 4 in which said separator is a hydraulically impermeable cation exchange membrane.

6. The electrolytic cell of claim 5 in which said porous electrode has a porosity of from about 70 to about 98 percent.

7. The electrolytic cell of claim 6 in which said porous electrode is a reticulate electrode.

8. The electrolytic cell of claim 7 in which said reticulate electrode is a cathode.

9. The electrolytic cell of claim 7 in which said reticulate electrode is an anode.

10. The electrolytic cell of claim 1 in which said anode and said cathode are porous electrodes.

11. The electrolytic cell of claim 2 in which said separator is positioned vertically within said housing.

12. The electrolytic cell of claim 11 in which the angle of inclination between the separator and the second portion of said porous electrode is from about 2 to about 8 degrees.

13. The electrolytic cell of claim 12 having a plurality of porous electrodes.

14. The electrolytic cell of claim 13 in which said porous electrodes are reticulate electrodes.

15. A process for the electrolysis of an aqueous alkali metal chloride solution employing the electrolytic cell of claim 1, said process comprising applying electrolysis current between anode and cathode to produce chlorine and alkali metal hydroxide.

16. An electrolytic cell for the electrolysis of aqueous solutions to produce gaseous products which comprises a housing, a separator positioned vertically in said housing to form an anode compartment and a cathode compartment, an anode in said anode compartment adjacent to said separator, a cathode in said cathode compartment adjacent to said separator, means for introducing an electrolyte into and removing said electrolyte from said anode compartment, an outlet for gaseous products in said anode compartment, means for introducing a liquid into and removing a liquid from said cathode compartment, an outlet for gaseous products in said cathode compartment, means for supplying electrical current to said anode and said cathode, at least one of said anode and said cathode comprising a porous electrode having a porosity in the range of from about 30 to about 98 percent, said porous electrode having a first lower portion in direct contact with said separator and a second upper portion spaced apart from said separator to provide a fluid release zone between said separator and said second portion.

* * * * *